United States Patent [19]

Patterson et al.

[11] 4,215,798

[45] Aug. 5, 1980

[54] CONTAINER FOR CRYOGENIC LIQUID

[75] Inventors: Michael F. Patterson, Clarence Center; Arun Acharya, East Amherst, both of N.Y.

[73] Assignee: Union Carbide Corporation, New York, N.Y.

[21] Appl. No.: 3,602

[22] Filed: Jan. 15, 1979

[51] Int. Cl.[2] ..... B65D 25/18; F17C 3/02; F17C 13/00

[52] U.S. Cl. ..... 220/421; 29/455 R; 55/269; 55/387; 62/45; 220/422; 220/901

[58] Field of Search ..... 220/420, 421, 422, 423, 220/424, 425, 426, 429, 901, 371; 62/45; 55/16, 387, 158, 74, 269; 29/455 R

[56] References Cited

U.S. PATENT DOCUMENTS

| | | | |
|---|---|---|---|
| 662,217 | 11/1900 | Brady | 220/901 X |
| 673,073 | 4/1901 | Bobriek | 220/426 |
| 1,398,841 | 11/1921 | Conover | 220/901 X |
| 1,835,699 | 12/1931 | Edmonds | 220/422 |
| 2,195,077 | 3/1940 | Brown | 220/422 X |
| 2,547,607 | 4/1951 | Sulfrian | 220/424 |
| 2,643,021 | 6/1953 | Freedman | 220/424 |
| 2,732,092 | 1/1956 | Lawrence | 220/371 |
| 2,900,800 | 8/1959 | Loveday | 62/45 |
| 2,934,392 | 4/1960 | Santis et al. | 313/220 X |
| 2,986,891 | 6/1961 | McMahon | 62/45 |
| 3,069,045 | 12/1962 | Hanmann et al. | 220/421 |
| 3,147,877 | 9/1964 | Beckman | 220/423 X |
| 3,225,954 | 12/1965 | Herrick et al. | 220/420 |
| 3,271,924 | 9/1966 | Gramm et al. | 53/452 |
| 3,295,709 | 1/1967 | Herrick et al. | 220/420 |
| 3,296,773 | 1/1967 | Hemstreet | 55/269 X |
| 3,338,034 | 8/1967 | Hemstreet | 55/269 |
| 3,461,678 | 8/1969 | Klipping et al. | 220/421 X |
| 3,828,960 | 8/1974 | Walles | 215/13 R |
| 3,930,375 | 1/1976 | Hofmann | 220/421 X |
| 4,154,363 | 5/1979 | Barthel | 220/421 |

FOREIGN PATENT DOCUMENTS 1294995 11/1972 United Kingdom .

*Primary Examiner*—Allan N. Shoap
*Attorney, Agent, or Firm*—Steven J. Hultquist; John J. Kelly, Jr.

[57] ABSTRACT

A double-walled container having spaced-apart inner and outer wall members enclosing a sealed insulation space, with at least a portion of the wall members being formed of a polymeric thermoplastic material selected from the group consisting of polyethylene, polypropylene, polytetrafluoroethylene and polychlortrifluoroethylene, uncoated with any permeation barrier coatings, so as to be gas permeable. A mass of pelletized adsorbent is disposed in the insulation space in thermal contact with the inner wall member. The introduction of cryogenic liquid to the container effects cooling of the inner wall member and adsorbent in thermal contact therewith, thereby causing increased adsorption of gas in the insulation space by the adsorbent for reduction of pressure therein and enhancement of the insulation quality of the insulation space. Complete removal of cryogenic liquid from the container effects warming of the inner wall member and adsorbent, thereby causing desorption of gas from the adsorbent disposed in the insulation space to raise pressure therein and cause pressure in the insulation space above pressure of the exterior environment of the container to be at least partially relieved by flow of gas through the polymeric thermoplastic wall member portion from the insulation space to the exterior environment.

14 Claims, 3 Drawing Figures

CONTAINER FOR CRYOGENIC LIQUID

BACKGROUND OF THE INVENTION

1. Field of the Invention

This invention relates to a double-walled container for cryogenic liquid of the type having spaced-apart inner and outer wall members enclosing a sealed insulation space, and to a method of fabricating same.

2. Description of the Prior Art

For storage and dispensing of cryogenic liquids, double-walled containers are commonly employed which comprise spaced-apart inner and outer wall members enclosing a sealed insulation space. The insulation space of such containers frequently contains a low conductivity thermal insulation material to enhance the insulation quality of the insulation space.

In containers of the above-described type, the insulation space is advantageously evacuated to provide and maintain at least partial vacuum conditions in the space so as to reduce heat leak via gaseous conduction and convection from the outer wall member at ambient temperature to the inner wall member adjacent the cryogenic liquid. For such reason, sorbent materials such as physical adsorbent materials and getters are frequently disposed in the insulation space to maintain vacuum therein after initial mechanical evacuation and sealing of the insulation space. In such manner, the sorbent materials take up the gases which enter the insulation space as a result of leakage through vessel joints and permeation of gases through the walls enclosing the insulation space and evolution of gases within the insulation space resulting from degassing of the materials of construction thereof.

Due to its chemical stability, extremely low gas permeability and low thermal conductivity, glass has been widely used as a material of construction for wall members of double-walled cryogenic liquid containers, particularly those containers of small size commonly referred to as dewar flasks. However, the fragility of glass and its associated susceptibility to breakage has limited its practical utility, particularly with respect to the alternative of using metal as a material of construction for such containers.

Double-walled containers of metal construction are structurally rugged relative to glass and other frangible materials, but are comparatively expensive to fabricate and suffer from the disadvangage that most metals have a relatively high thermal conductivity which in turn results in substantial heat leak from the warm outer wall of the insulation space to the cold inner wall thereof. Despite such shortcomings, double-walled metal containers have been widely used in practice due to the strength, rigidity and low permeability of metals as a material of construction.

More recently, there has been interest in thermoplastic polymeric materials in construction of double-walled cryogenic liquid containers, as a result of the low cost, low thermal conductivity, light weight and ease of forming thereof, as for example by injection molding, rotation molding and the like. Despite the attractiveness of polymeric thermoplastic materials as materials of construction for wall members of cryogenic liquid containers, such materials have the drawback of relatively high gas permeabilities, which has limited the usage of such materials in practice. This is due to the fact that the vacuum which the prior art has sought to continuously maintain in the insulation space of the double-walled container is rapidly degraded unless an excessive amount of gas sorbent material is disposed in the insulation space to take up the substantial volume of gases permeating into the insulation space through the polymeric thermoplastic wall members of the container.

Faced with the foregoing problem of relatively high permeability of polymeric thermoplastic materials of construction, the prior art has proposed various approaches for reduction of permeability of such materials when employed to form vacuum-retaining insulation space wall members. The prior art has for example proposed that the polymeric thermoplastic wall members be provided with a metallic coating, such as by electroplating of the wall surface to be exposed to the vacuum space or by application of metallic foils to such surfaces, so as to reduce permeation inleakage of gas into the insulation space of the container to insignificant levels which can readily be accommodated by small quantities of gas sorbent materials disposed in the insulation space. Another approach of the prior art to reduce permeability of the polymeric thermoplastic wall members has been to provide surface-reacted coatings which chemically bond to selected constituents of the polymeric molecular chains to form a barrier coating on the surface of the thermoplastic polymeric substrate, for reduction of the gas permeability thereof. Yet another approach proposed by the prior art involves the formation of composite insulation space wall members composed of laminates of the polymeric thermoplastic material and a low permeability material such as glass or metal. Although these approaches are to varying degrees successful in reducing permeability of the vacuum-retaining polymeric thermoplastic wall members, such approaches substantially increase the cost and complexity of fabricating the insulation space wall members.

An associated difficulty which has heretofore been encountered in fabrication of double-walled containers, regardless of the materials of construction employed, is the requirement of forming the enclosed insulation space under vacuum conditions so as to avoid the necessity for excessive amounts of gas sorbent materials in the insulation space to achieve at least partial vacuum therein. Accordingly, in conventional practice, double-walled vacuum-insulated containers have either been assembled in a vacuum chamber or else the enclosed insulation space is formed and then evacuated by external means such as vacuum pumps prior to final closure and sealing of the insulation space. The necessity of providing an initial low pressure or vacuum condition in the insulation spaces contributes significantly to the overall cost and complexity of fabricating the double-walled container.

Accordingly, it is an object of the present invention to provide an improved container for cryogenic liquid of the type having spaced-apart inner and outer wall members enclosing a sealed insulation space.

It is another object of the invention to provide an improved method of fabricating a cryogenic liquid container of the above type.

It is another object of the invention to provide a cryogenic liquid container comprising wall members bounding a vacuum insulation space which includes wall member portions formed of high permeability polymeric thermoplastic material uncoated with any permeation barrier coatings.

It is still another object of the invention to provide a method of fabrication of a double-walled vacuum-insulated cryogenic liquid container wherein the container may be completely fabricated under ambient pressure conditions, without the need for any insulation space evacuation means.

Other objects and advantages of this invention will be apparent from the ensuing disclosure and appended claims.

SUMMARY OF THE INVENTION

This invention relates to a double-walled container for storage and dispensing of cryogenic liquid, and to a method for fabrication of same.

The double-walled container of this invention comprises spaced-apart inner and outer wall members enclosing a sealed insulation space, the inner wall member having an inner surface forming a receptacle for cryogenic liquid, with at least a portion of the wall members being formed of a polymeric thermoplastic material selected from the group consisting of polyurethane, polypropylene, polytetraflouroethylene and polychlortrifluoroethylene, uncoated with any permeation barrier coatings whereby the polymeric thermoplastic wall member portion is permeable to gas flow between an exterior environment of the container and the insulation space. A mass of adsorbent is disposed in the insulation space in thermal contact with the inner wall member, whereby: (1) introduction of cryogenic liquid into the container receptacle effects cooling of the inner wall member and the adsorbent in thermal contact therewith thereby causing increased adsorption of gas in the insulation space by the adsorbent for reduction of pressure therein and enhancement of the insulation quality of the insulation space, and (2) complete removal of cryogenic liquid from the container receptacle effects warming of the inner wall member and adsorbent in thermal contact therewith, thereby causing desorption of gas from the adsorbent in the insulation space to raise pressure therein and cause pressure in the insulation space above pressure of the exterior environment of the container to be at least partially relieved by flow of gas through the polyethylene or polypropylene wall member portion from the insulation space to the exterior environment. In this container the ratio of mass of the adsorbent, in grams, to volume of the insulation space, in cubic centimeters, is from 0.005 to 0.150.

The method aspect of the invention relates to fabricating a double-walled container for storage and dispensing of cryogenic liquid, comprising providing a smaller inner wall member and a larger outer wall member in spaced relationship to one another to form an insulation space therebetween, the inner wall member having an inner surface forming a receptacle for the cryogenic liquid and at least a portion of the wall members being formed of a polymeric thermoplastic material selected from the group consisting of polyethylene, polypropylene polytetrafluoroethylene, and polychlortrifluoroethylene, uncoated with any permeation barrier coatings, whereby the polymeric thermoplastic wall member portion is gas-permeable. A mass of adsorbent is placed in the insulation space in thermal contact with the inner wall member and the insulation space is leak-tightly sealed under atmospheric conditions to form the container having the inner and outer wall members bounding the sealed insulation space containing gas at atmospheric pressure. Under the foregoing, the adsorbent is provided in the insulation space in an amount such that the ratio of mass of the adsorbent, in grams, to volume of the insulation space, in cubic centimeters, is from 0.005 to 0.150.

The above-described method provides a container so constructed that in subsequent use (1) introduction of cryogenic liquid into the container receptacle effects cooling of the inner wall member and the adsorbent in thermal contact therewith, thereby causing increased adsorption of gas in the insulation space by the adsorbent for reduction of pressure therein and enhancement of the insulation quality of the insulation space and (2) complete removal of cryogenic liquid from the container receptacle effects warming of the inner wall member and adsorbent in thermal contact therewith, thereby causing desorption of gas from the adsorbent in the insulation space to raise pressure therein and cause pressure in the insulation space above pressure of an exterior environment of the container to be at least partially relieved by flow of gas through the polymeric thermoplastic wall member portion from the insulation space to the exterior environment.

As used herein, "polyethylene, polypropylene, polytetrafluoroethylene and polychlortrifluoroethylene, uncoated with any permeation barrier coatings" means polyethylene, polypropylene, polytetrafluoroethylene, and polychlortrifluoroethylene which is not provided or treated with any coatings, sealant layers, foils or other means, compounds or structural members, or in any manner laminated therewith, in such manner as to reduce the gas permeability of the polyethylene or polypropylene by more than 90%. In other words, even though such polymeric thermoplastic materials are processed so as to reduce their gas permeability by factors of up to 90%, the resulting materials are still susceptible to substantial permeation leakage of gas therethrough and may be usefully employed in the practice of the present invention, even though such materials would be wholly unacceptable as materials of construction for vacuum-retaining wall members in containers fabricated in accordance with the prior art.

As also used herein, "adsorbent disposed in thermal contact with the inner wall member" means that the adsorbent is bonded to and physically arranged in conductive heat transfer relationship with an associated surface of the inner wall member so that the adsorbent is maintained at substantially the same temperature as the associated surface of the inner wall member. The phrase "cause pressure in the insulation space above pressure of the exterior environment of the container to be at least partially relieved by flow of gas through the polymeric thermoplastic wall member portion from the insulation space to the exterior environment" means that any excess partial pressure of a given gas component in the insulation space above the partial pressure of that component in the exterior environment will cause permeation of the gas component from the insulation space through the polymeric thermoplastic wall member portion to the exterior environment, with such permeation flow tending eventually to equalize gas component partial pressures in the insulation space and exterior environment.

BRIEF DESCRIPTIONS OF THE DRAWINGS

DESCRIPTION OF THE PREFERRED EMBODIMENTS

The present invention is based in part on the discovery that highly gas-permeable thermoplastic polymeric materials such as polyethylene, polypropylene, polytetrafluoroethyelene and polychlortrifluoroethyelene may be usefully employed as materials of construction for vacuum-retaining walls of a double-walled cryogenic liquid container despite their high permeability, a seeming disadvantage which the prior art has taught to overcome by coating or plating the thermoplastic polymeric wall member with various permeation barrier media such as metals. In accordance with the present invention, highly gas-permeable thermoplastic polymeric materials are used without such permeation barrier coatings in a vessel wherein adsorbent disposed in thermal contact with the insulation space wall member adjacent the cryogenic liquid is chilled by the liquid to provide high sorptive affinity for gases present in the insulation space and thereby reduce gas pressure therein to the desired low operating level. Subsequent warmup of the adsorbent when the container is emptied of cryogenic liquid causes desorption of previously adsorbed gases, resulting in increased gas pressure in the insulation space which causes excess gas partial pressures therein relative to the exterior environment to be at least partially relieved by gas permeation through the highly gas-permeable thermoplastic polymeric wall portions into the exterior environment. Such self-expulsion of gases from the insulation space tends to maintain the quantity of gases in the insulation space at a level which can be adequately sorbed by the adsorbent when the container is in service and holding cryogenic liquid, so that the desired low gas pressure levels can be maintained in the insulation space during such service.

Figure 1:
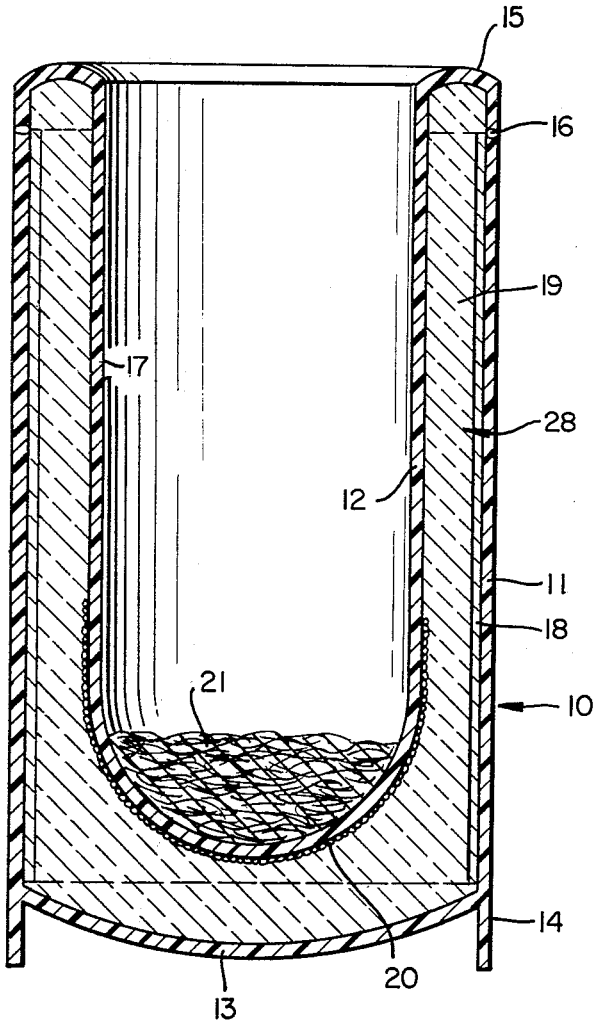
FIG. 1 is a sectional, elevational view of a double-walled container constructed in accordance with the present invention

Referring now to the drawings, FIG. 1 is a sectional, elevational view of an illustrative double-walled container for storage and dispensing of cryogenic liquid as constructed in accordance with the present invention. The container comprises spaced-apart inner and outer wall members, 12 and 11 respectively, enclosing a sealed insulation space 28. The inner wall member 12 has an inner surface 17 forming a receptacle for the cryogenic liquid and is provided with a transversely extending top wall portion 15 from which a downwardly depending lip portion extends for joining to the outer wall member 11 by welded joint 16.

Outer wall 11 of container 10 is formed with a lower portion 13 presenting a concave surface of the insulation space 28, the lower portion 13 being joined to the lower extremity of the side wall portion, and with the latter terminating in a downwardly extending lower portion 14 for support of the vessel. At least a portion of the inner and outer wall members 12 and 11 are formed of a polymeric thermoplastic material selected from the group consisting of polyethylene, polypropylene, polytetrafluoroethylene, and polychlortrifluoroethylene, uncoated with any permeation barrier coatings, whereby the polymeric thermoplastic wall member portion is permeable to gas flow between an exterior environment of the container and the insulation space 28. In preferred practice of the invention the inner wall comprises such polymeric thermoplastic wall member portion and most preferably both of the inner and outer wall members are formed entirely of the aforementioned polymeric thermoplastic material. When both wall members are formed entirely of the polymeric thermoplastic material, the joint 16 may suitably be formed by ultrasonic or induction welding or other conventionally employed plastics joining methods. Where both wall members are formed entirely of polyethylene, polypropylene, polytetrafluoroethylene or polychlortrifluoroethylene, the aforementioned polymeric thermoplastic wall member portion which is uncoated with any permeation barrier coatings may suitably include at least part of each of the inner and outer wall members, such as is shown in FIG. 1. In the FIG. 1 embodiment, only a portion of the outer wall member constitutes the polymeric thermoplastic wall member portion uncoated with any permeation barrier coatings, inasmuch as a cylindrical metallic liner 18 is disposed against the inner surface of the outer wall member 11, to reinforce the latter and provide enhanced ridigity and mechanical strength of the container.

In the lower portion of the cryogenic receptacle formed by the inner surface 17 of inner wall member 12 of the container may be disposed a mat of fibrous cushioning material 21 to protect the container from sudden shocks and stresses attendant the introduction of solid objects into the receptacle for freezing by cryogenic liquid therein. In the insulation space 28, a particulate or multilayered insulation medium 19 is disposed to enhance the insulation quality of space 28.

At the lower portion of the outer surface of inner wall member 12, a mass 20 of adsorbent pellets is disposed in the insulation space in thermal contact with the inner wall member. A highly suitable adsorbent for this purpose is activated carbon in the form of pellets, having a bulk density of at least 20 lbs. per cubic ft. and a surface area of at least $20m^2/gm$; such adsorbent provides sufficient aggregate adsorptive capacity for taking up inleaking gases in the vacuum space 28 during use, when the container receptacle contains cryogenic liquid, without the need for provision of an excessive quantity of such adsorbant. As used herein, "bulk density" means the density of the adsorbent mass including voids between adjacent adsorbent pellets. In preferred practice, the bonded adsorbent pellets should not protrude from the inner wall substrate more than about 0.15 inch in order that the pellets may be fully and rapidly chilled to substantially substrate temperature when the container is placed in service and filled with cryogenic liquid.

In the broad practice of the present invention, the cryogenic liquid container is constructed such that the ratio of mass of the adsorbent, in grams, to volume of the insulation space, in cubic centimeters, is from 0.005 to 0.150. This ratio should not have a value of less than 0.005, for the reason that at lower values the mass of adsorbent provided tends to be inadequate to accommodate the potential leakage of gas, e.g., ambient air, into the insulation space, so that in use, the pressure level in the insulation space is not reduced to a value commensurate with high insulation quality. On the other hand, at ratio values above about 0.150, there tends to be an excessive amount of adsorbent provided relative to the given volume of insulation space, with the result that it is disproportionately more difficult to maintain all of the adsorbent in good thermal contact with the inner wall member of the container, so that the adsorbent may be fully and rapidly chilled to substantially the inner wall temperature when the container is placed in service and filled with cryogenic liquid. In addition, at such high ratio values, the relative amount of adsorbent may be so large as to bridge the insulation space from the outer (ambient temperature) wall member to the inner (cryogenic temperature) wall member, with the potentially severe result of excessive solid conduction heat leak across the insulation space to the contained cryogenic liquid.

In preferred practice, the adsorbent is disposed in the insulation space in thermal contact with the inner wall member in the form of a substantially single pellet layer of adsorbent pellets bonded to the inner wall member, as discussed in greater detail hereinafter. A preferred adsorbent material is activated carbon, due to its high capacity for oxygen and nitrogen despite substantial loadings of coadsorbed water, such as enters the insulation space by water vapor permeation through the thermoplastic polymeric wall member portions.

The portion of the wall members formed of polymeric thermoplastic material uncoated with any permeation barrier coating is preferably from 50 to 200 mills in thickness to provide sufficient strength and rigidity without excessive thickness levels such as would unduly increase the cost and complexity of fabricating the wall members of the container.

In use of the FIG. 1 container, the introduction of cryogenic liquid into the container receptacle, formed by the inner surface 17 of inner wall 12, effects cooling of the inner wall member 12 and the adsorbent 20 in thermal contact therewith, thereby causing increased adsorption of gas in the insulation space 28 by the adsorbent for reduction of pressure therein and enhancement of the insulation quality of the insulation space 28. Subsequently, the complete removal of cryogenic liquid from the container receptacle effects warming of the inner wall member 12 and adsorbent 20 in thermal contact therewith, thereby causing desorption of previously adsorbed gases from the adsorbent in the insulation space to raise pressure therein and cause pressure in the insulation space above pressure of the exterior environment of the container to be at least partially relieved by flow of gas through the polymeric thermoplastic wall member portion from the insulation space to the exterior environment. Thus, in the FIG. 1 embodiment, if the warm-up of the adsorbent and the associated gas desorption therefrom in the insulation space 28 result in a final insulation space pressure comprising gas component partial pressures which are less than the partial pressures for such components in the exterior environment of the container, further permeation of gases from the exterior environment of the container into the insulation space will continue until the insulation space gas component partial pressures are equal to the external environment partial pressures for such gas components. On the other hand, if the quantity of gases taken up by the adsorbent while in service, with the adsorbent chilled by the cryogenic liquid held in the container, is sufficiently great to cause the gas component partial pressures within the insulation space 28 upon warm-up of the adsorbent to rise to values which exceeds the partial pressures of such gas components in the exterior environment of the container, such overpressure will be relieved by permeation of gases from the insulation space 28 to the exterior environment of the container. In the FIG. 1 embodiment, if the inner wall 12 and outer wall 11 are formed entirely of polymeric thermoplastic material, such excess pressure will be relieved by permeation of gases from the insulation space 28 primarily through the inner wall 12 and through the bottom portion 13 of outer wall member 11. The outleakage of gas through the polymeric thermoplastic wall member portions will continue until the gas component partial pressures in the insulation space have equalized with the partial pressures of such gas components in the exterior environment of the container. Subsequently, when the container is again placed in service to hold cryogenic liquid, the gases then present in the insulation space 28 will be adsorbed by the cooled adsorbent 20 to reduce the gas pressure level in the insulation space 28 to the desired low level.

It will be appreciated from the foregoing discussion that the construction of the cryogenic liquid container of the invention is such as to allow the container to be fabricated under atmospheric conditions (ambient pressure) without the necessity of evacuated assembly chambers or vacuum pumping systems such as have been required to fabricate double-walled vacuum-insulated cryogenic liquid containers of the prior art. Thus, the container of the present invention may be fabricated and the insulation space thereof sealed without initial evacuation thereof to a low vacuum pressure level, inasmuch as gases present in the insulation space will be taken up by the adsorbent when the container is placed in service, with the cryogenic liquid held in the container receptacle serving to cool the adsorbent to low temperature and thereby increase its sorptive affinity to an extent consistent with the desired operating pressure level in the insulation space.

In connection with the foregoing, the illustrative cryogenic liquid container shown in FIG. 1 may be fabricated as follows. The adsorbent 20 is placed in thermal contact with the outer surface of inner wall member 12 as shown and hereinafter described in greater detail. The smaller inner wall member 12 and the larger outer wall member 11 are then placed in spaced relationship to one another to form the insulation space 28 therebetween with the particulate or multilayered insulation medium 19 being disposed in the insulation space. The insulation space is thereupon leak-tightly sealed, as for example by ultrasonic welding of the joint 16, to form the container as shown in FIG. 1 having the inner and outer wall members bounding the sealed insulation space containing air or other exterior environment gas at atmospheric (ambient) pressure level, with the so-formed vessel thereafter operating in the manner previously described.

Figure 2:
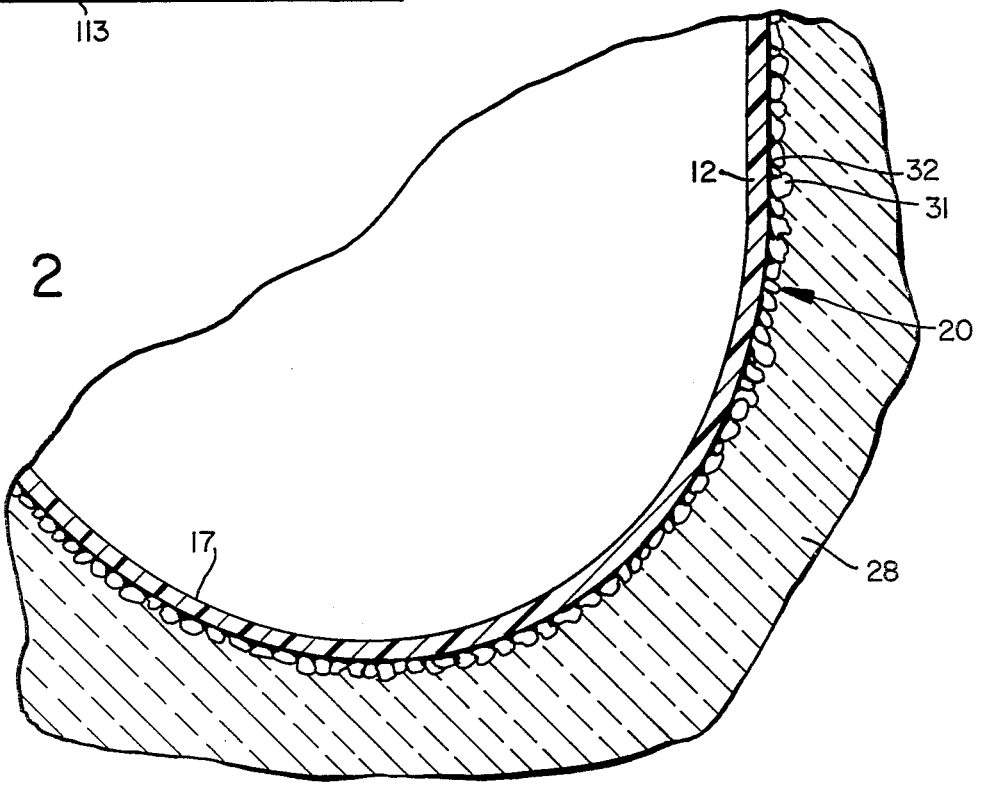
FIG. 2 is a sectional, elevational view of a portion of the cryogenic liquid container of FIG. 1, showing the details of the adsorbent layer disposed on the outer surface of the inner wall member of the container.

FIG. 2 is a sectional, elevational view of a portion of the cryogenic liquid container of FIG. 1 showing the details of the adsorbent mass disposed in thermal contact with the outer surface of the inner wall member 12. As shown, the adsorbent disposed in the insulation space in thermal contact with the inner wall member 12 comprises a substantially single pellet layer of 20 of adsorbent pellets 31 bonded by bonding medium 32 to the outer surface of the inner wall so that the adsorbent pellets 31 present a substantial surface area to the insulation space 28. The bonding of the layer of adsorbent pellets 31 to the outer surface of the inner wall 12 must be such as to accommodate repetitive warming and cooling cycles associated with the introduction of liquid to the container receptacle and the removal of cryogenic liquid from the receptacle. If the inner wall 12 is formed of a readily adhesively bondable material, the layer of adsorbent 20 may be placed in thermal contact with the inner wall member 12 by application of a thin layer of epoxy resin as the bonding medium 32 to the outer surface of the inner wall member 12, with the adsorbent pellets 31, e.g., activated carbon pellets of 6–10 mesh size, thereupon being applied to the adhesive-coated inner wall member outer surface. Thereafter, the epoxy bonding medium is allowed to cure in a conventional manner to form the layer of adsorbent pellets bonded to the inner wall member. If, however, as may be preferred in practice, the inner wall member 12 of the cryogenic liquid container is composed entirely of polyethylene, polypropylene, polytetrafluoroethylene or polychlortrifluoroethylene, the preceding method of forming the layer of adsorbent pellets on the inner wall member outer surface may not be satisfactory, for the reason that such polymeric thermoplastic materials possess a surface to which it is difficult to obtain strong adhesive bonding. With such thermoplastic polymeric inner wall member, the flame spray method for forming an adhesively bondable thermoplastic polymeric surface which is disclosed in co-pending application Ser. No. 003,601 entitled "Method of Forming an Adhesively Bondable Thermoplastic Polymeric Surface," filed Jan. 15, 1979 in the name of F. Notaro, has been found to be useful in practice in forming the layer of adsorbent pellets on the inner wall member of the cryogenic liquid container.

Figure 3:
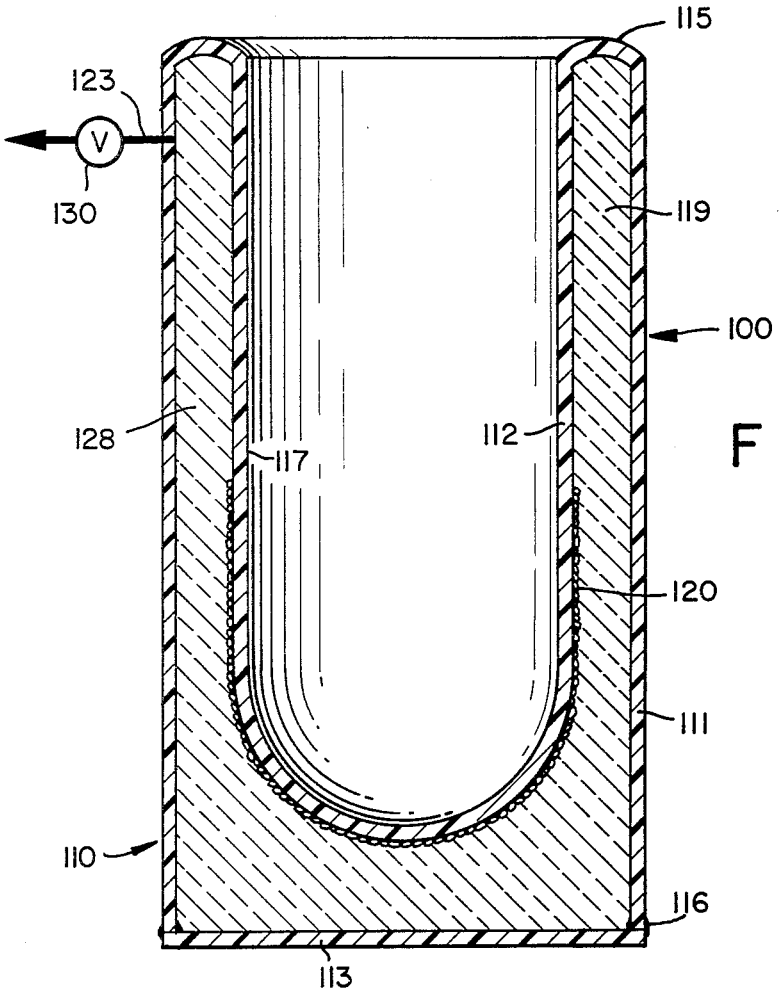
FIG. 3 is a sectional, elevational view of another container embodiment, constructed in accordance with the present invention.

FIG. 3 shows a sectional, elevational view of a cryogenic liquid container according to another embodiment of the present invention. In this embodiment, container 110 has an outer wall member which comprises the side wall portion 111 of wall member 100 together with the bottom wall member 113, the latter being joined to the side walls 111 at joint 116. The wall member 100 is integrally formed to include the aforementioned side wall portion 111, top wall portion 115 and inner wall member portion 112. Insulation space 128 between the inner and outer wall members is filled with an insulation medium 119, which may suitably comprise particulate or multilayer insulation of conventional type. The inner wall surface 117 of the inner wall member 112 forms a receptacle for cryogenic liquid and a mass of adsorbent 120 is disposed in the insulation space in thermal contact with the inner wall mem- ber. In this embodiment, a gas flow passage 123 extends through the outer wall member and joins the insulation space 128 with a pressure relief valve 130 discharging to the exterior environment of the container, to assist in relieving pressure in the insulation space above pressure of the external environment of the container. Alternatively, or in addition, a portion of one of the container's wall members could be formed of reduced thickness relative to the remainder of the wall member to form a "blow-out" wall section which will burst if the pressure level becomes so excessively high as to constitute a safety hazard.

The cryogenic liquid container shown in FIG. 3 functions in use in the same manner previously described for the embodiment of FIGS. 1 and 2. Introduction of cryogenic liquid into the container receptacle 117 effects cooling of the inner wall member 112 and the adsorbent 120 in thermal contact therewith, thereby causing increase of adsorption of gas in the insulation space 128 by the adsorbent for reduction of pressure in the insulation space and enhancement of the insulation quality, i.e., reduction of the heat leak from the exterior environment of the container to the cryogenic liquid contained therein, of the insulation space. Subsequently, complete removal of cryogenic liquid from the container receptacle effects warming of the inner wall member 112 and adsorbent 120 in thermal contact therewith, thereby causing desorption of gas from the adsorbent in the insulation space 128 to raise pressure therein and cause pressure in the insulation space above pressure of the external of the container to be partially relieved by flow of gas through the polymeric thermoplastic wall member portions 111, 112, 113 and 115 from the insulation space 128 to the exterior environment. In accordance with the present invention, the ratio of mass of the adsorbent 120, in grams, to the volume of the insulation space 128, in cubic centimeters, is from 0.005 to 0.150.

Although preferred embodiments of this invention have been described in detail, it is contemplated that modification of the method and apparatus described may be made and some features may be employed without others, all within the spirit and scope of the invention. For example, although the invention has been described with particular reference to the use of polyethylene, polypropylene, polytetrafluoroethylene or polychlortrifluoroethane as materials of construction for insulation space wall members, it will be appreciated that the invention may be usefully employed with other thermoplastic polymeric materials which have heretofore been used to form insulation space wall members only when coated with permeation barrier coatings, due to the high gas permeability of such thermoplastic polymeric materials. In addition, it will be recognized that the method of fabrication used in forming the container of the present invention may usefully be applied to the fabrication of wholly metal-walled vessels to avoid the necessity for evacuation of the vessel's insulation space prior to sealing of same.

What is claimed is:

1. A double-walled container for storage and dispensing of cryogenic liquid comprising:

spaced-apart inner and outer wall members enclosing an insulation space, said inner wall member being free of openings communicating with said insulation space and having an inner surface forming a receptacle for said cryogenic liquid, with said wall members being entirely formed of a polymeric thermoplastic material selected from the group consisting of polyethylene, polypropylene, polytetrafluoroethylene and polychlortrifluoroethylene, said inner member being uncoated with any permeation barrier coatings, said polymeric thermoplastic wall members being permeable to gas flow between an exterior environment of said container and said insulation space; and a mass of adsorbent disposed in said insulation space in thermal contact with said inner wall member, said container characterized whereby:

(1) introduction of cryogenic liquid into said container receptacle effects cooling of said inner wall member and said adsorbent in thermal contact therewith thereby causing increased adsorption of gas in said insulation space by said adsorbent for reduction of pressure therein and enhancement of the insulation quality of said insulation space, and (2) complete removal of cryogenic liquid from said container receptacle effects warming of said inner wall member and adsorbent in thermal contact therewith, thereby causing desorption of gas from said adsorbent in said insulation space to raise pressure therein and cause pressure in said insulation space above pressure of said exterior environment of said container to be at least partially relieved by flow of gas through said polymeric thermoplastic wall members from said insulation space to said exterior environment, wherein the ratio of mass of said adsorbent, in grams, to volume of said insulation space, in cubic centimeters, is from 0.005 to 0.150.

2. A container according to claim 1 wherein said adsorbent is activated carbon.

3. A container according to claim 2 wherein said activated carbon adsorbent has a surface area of at least 20 $m^2/gm$.

4. A container according to claim 1 wherein said polymeric thermoplastic wall member portion is from 50 to 200 mils in thickness.

5. A container according to claim 1 wherein said insulation space contains an insulant selected from the group consisting of particulate and multilayered insulation media.

6. A container according to claim 1 wherein a gas flow passage extends through said outer wall member and joins said insulation space with a pressure relief valve discharging to said exterior environment, to assist in relieving pressure in said insulation space above pressure of said exterior environment of said container.

7. A container according to claim 1 wherein said adsorbent disposed in said insulation space in thermal contact with said inner wall member comprises a substantially single pellet layer of adsorbent pellets bonded to said inner wall member.

8. A container according to claim 1 wherein at least a portion of said outer wall member is provided with a permeation barrier.

9. A method of fabricating a double-walled container for storage and dispensing of cryogenic liquid, comprising the steps of:

(a) providing a smaller inner wall member and a larger outer wall member in spaced relationship to one another to form an insulation space therebetween, said inner wall member being free of openings communicating with said insulation space and having an inner surface forming a receptacle for said cryogenic liquid and said wall members being entirely formed of polymeric thermoplastic material selected from the group consisting of polyethylene, polypropylene, polytetrafluoroethylene and polychlortrifluoroethylene, said inner member being uncoated with any permeation barrier coatings, said polymeric thermoplastic wall members being permeable to gas flow between an exterior environment of said container and said insulation space;

(b) placing a mass of adsorbent in said insulation space in thermal contact with said inner wall member; and (c) enclosing said insulation space with said inner and outer wall members under atmospheric conditions to form said container having said inner and outer wall members bounding the insulation space containing gas at atmospheric pressure, and said container characterized whereby in subsequent use (1) introduction of cryogenic liquid into said container receptacle effects cooling of said inner wall member and said adsorbent in thermal contact therewith, thereby causing increased adsorption of gas in said insulation space by said adsorbent for reduction of pressure therein and enhancement of the insulation quality of said insulation space and (2) complete removal of cryogenic liquid from said container receptacle effects warming of said inner wall member and adsorbent in thermal contact therewith, thereby causing desorption of gas from said adsorbent in said insulation space to raise pressure therein and cause pressure in said insulation space above pressure of an exterior environment of said container to be at least partially relieved by flow of gas through said polymeric thermoplastic wall members from said insulation space to said exterior environment, and wherein the adsorbent is provided in said insulation space in an amount such that the ratio of mass of said adsorbent, in grams, to volume of said insulation space, in cubic centimeters, is from 0.005 to 0.150.

10. A method according to claim 9 comprising disposing an insulant selected from the group consisting of particulate and multilayered insulation media between said inner and outer wall members prior to enclosing said insulation space, whereby the enclosed insulation space contains said insulation medium to enhance the insulation quality thereof.

11. A method according to claim 9 comprising forming a gas flow passage in said outer wall member to provide gas flow communication between said insulation space and said exterior environment of said container, and joining said gas flow passage with a pressure relief valve discharging to said exterior environment, to assist in relieving pressure in said insulation space above pressure of said exterior environment of said container.

12. A method according to claim 9 wherein said step of placing a mass of adsorbent in said insulation space in thermal contact with said inner wall member comprises bonding a substantially single pellet layer of adsorbent pellets to said inner wall member.

13. A method according to claim 9 comprising providing activated carbon as said adsorbent.

14. A method according to claim 9 which further comprises providing at least a portion of said outer wall member with a permeation barrier.

* * * * *